US006860725B2

(12) United States Patent
Park et al.

(10) Patent No.: US 6,860,725 B2
(45) Date of Patent: Mar. 1, 2005

(54) SUCTION GAS GUIDING SYSTEM FOR RECIPROCATING COMPRESSOR

(75) Inventors: Jung-Sik Park, Seoul (KR); Kyung-Seok Kang, Kimhae (KR); Seung-Tae Woo, Busan (KR)

(73) Assignee: LG Electronics Inc., Seoul (KR)

( * ) Notice: Subject to any disclaimer, the term of this patent is extended or adjusted under 35 U.S.C. 154(b) by 81 days.

(21) Appl. No.: 10/297,330

(22) PCT Filed: May 25, 2001

(86) PCT No.: PCT/KR01/00882

§ 371 (c)(1),
(2), (4) Date: Dec. 5, 2002

(87) PCT Pub. No.: WO02/081914

PCT Pub. Date: Oct. 17, 2002

(65) Prior Publication Data

US 2003/0156956 A1 Aug. 21, 2003

(30) Foreign Application Priority Data

Apr. 6, 2001 (KR) ..... 2001-18280

(51) Int. Cl.[7] ..... F04B 39/00; F04B 35/04

(52) U.S. Cl. ..... 417/312; 417/417; 181/212; 181/403

(58) Field of Search ..... 417/416, 312, 417/545, 547; 181/212, 403

(56) References Cited

U.S. PATENT DOCUMENTS 5,938,411 A * 8/1999 Seo ..... 417/312
5,993,178 A 11/1999 Park
6,089,836 A * 7/2000 Seo ..... 417/417
6,174,141 B1 1/2001 Song
6,398,523 B1 * 6/2002 Hur et al. ..... 417/417
6,435,842 B2 * 8/2002 Song ..... 417/363
6,540,490 B1 * 4/2003 Lilie ..... 417/416
6,666,662 B2 * 12/2003 Oh et al. ..... 417/417

FOREIGN PATENT DOCUMENTS

JP 2001-73943 A 3/2001

* cited by examiner

*Primary Examiner*—Charles G. Freay
(74) *Attorney, Agent, or Firm*—Birch, Stewart, Kolasch & Birch, LLP

(57) ABSTRACT

A suction gas guiding (100) system for a reciprocating compressor (30) includes a gas guide conduit (110) penetrating an inner stator of a reciprocating motor and having both ends installed on a suction pipe (50) of a shell (10) and on an inner flowing passage of a piston (31) so as to guide the sucked gas inside the shell (10) to the inner flowing passage, whereby the refrigerant gas is sucked into the inner flowing passage of the piston through the gas guide conduit smoothly, and accordingly, the suction rate of the refrigerant gas is increased. Therefore the efficiency of the compressor (30) is increased. In addition, noise and vibration generated when the refrigerant gas is sucked are attenuated in the resonant spaces, and therefore the flow resistance against the noise and the gas, whereby the reliability and efficiency of the compressor is increased.

26 Claims, 8 Drawing Sheets

SUCTION GAS GUIDING SYSTEM FOR RECIPROCATING COMPRESSOR

This application is the national phase under 35 U.S.C. § 371 of PCT International Application No. PCT/KR01/00882 which has an International filing date of May 25, 2001, which designated the United States of America.

TECHNICAL FIELD

The present invention relates to a suction gas guiding system for a reciprocating compressor, and particularly, to a suction gas guiding system for a reciprocating compressor which is suitable for introducing suction gas into a compressor unit smoothly, and for reducing suction noise in case of installing the compressor unit inside a reciprocating motor.

BACKGROUND ART

Generally, a reciprocating compressor can be divided into a compressor which compresses and discharges the sucked gas by changing a rotating movement of a driving motor into a reciprocating motion of a piston, and a compressor which compresses and discharges the sucked gas by making the piston undergo reciprocating movement while the driving motor undergoes linear reciprocating movement.

FIG. 1 is a transverse cross-sectional view showing an embodiment of the reciprocating compressor in which the driving motor undergoes the linear reciprocating movement.

As shown therein, a conventional reciprocating compressor comprises a shell 10 in which a suction pipe (SP) and a discharge pipe (DP) are communicated with each other; a reciprocating motor 20 fixed inside the shell 10; a compressor unit 30 installed inside the reciprocating motor 10, sucking, compressing, and discharging gas; a frame unit 40 supporting the reciprocating motor 20 and the compressor unit 30; and a spring unit 50 elastically supporting an armature 22 of the reciprocating motor 20 in motion direction and guiding a resonance.

The reciprocating motor 20 includes a stator 21 including an inner stator 21A and an outer stator 21B, and an armature 22 disposed in a gap between the inner stator 21A and the outer stator 21B and undergoing a reciprocating movement.

The compressor unit 30 comprises a piston 31 coupled to a magnet supporting member 22A of the reciprocating motor 20 and undergoing the reciprocating movement together with the magnet supporting member 22A; a cylinder 32 fixed on a front frame 41 which will be described later, and forming a compressing space with the piston; a suction valve 33 installed on front end of the piston and restricting the suction of gas by opening/closing a gas passing hole 31*b* of the piston which will be described later; and a discharge valve assembly 34 disposed on the front end of the cylinder 32, whereby covering the compressing space, and restricting the discharge of compressed gas.

An inner flowing passage 31*a* communicating with the suction pipe (SP) is formed to a certain depth inside the piston 31, and the gas passing hole 31*b* communicated with the inner flowing passage 31*a* and penetrated to front end surface of the piston 31 is formed.

The frame unit 40 includes a front frame 41 contacting to front surfaces of the inner stator 21A and of the outer stator 21B, whereby supporting the stators together, and in which the cylinder 32 is inserted; a middle frame 42 contacting to rear surface of the outer stator 21B, whereby supporting the outer stator 21B; and a rear frame 43 coupled to the middle frame 42 and supporting rear end of a rear spring 52 which will be described later.

The spring unit 50 includes front spring 51 having both ends supported by the front surface of coupled part of the magnet supporting member 22A and the piston 31 and by the corresponding inner surface of the front frame 41, and a rear spring 52 having both ends supported by rear surface of the coupled part of the magnet supporting member 22A and the piston 31, and by corresponding front surface of the rear frame 43.

Reference numeral 22B designates a magnet.

The conventional reciprocating compressor as described above is operated as follows.

That is, when an electric current is applied to the winding coil 21C installed on the outer stator 21B of the reciprocating motor 20 and a flux is generated between the inner stator 21A and the outer stator 21B, whereby the armature 22 located in the gap between the inner stator 21A and the outer stator 21B moves in accordance with the direction of the flux and undergoes reciprocating movement by the spring unit 50. And accordingly, the piston 22 coupled to the armature 22 undergoes reciprocating movement inside the cylinder 32, so that a volume variance is generated inside the compressing space, accordingly the refrigerant gas is sucked into the compressing space, then compressed and discharged.

The refrigerant gas is sucked inside the shell 10 through the suction pipe (SP) during the suction stroke of the piston, and the gas is sucked into the compressing space of the cylinder 32 as opening the suction valve 33 through the inner flowing passage 31*a* of the piston 31 and through the gas passing hole 31*b*. Then, the gas is compressed to a certain level during the compress stroke of the piston, and discharged through the discharge pipe 34 as opening the discharge valve assembly 34. And the whole process is repeated.

However, in the conventional reciprocating compressor as described above, the refrigerant gas sucked into the shell 10 through the suction pipe (SP) is dispersed inside the shell 10, whereby the density per unit volume is lowered. Accordingly, the actual amount of refrigerant gas sucked into the compressing space during the reciprocating movement of the piston 31 is low, whereby the efficiency of the compressor is lowered.

Also, the refrigerant gas sucked into the shell 10 is pre-heated by contacting to the reciprocating motor 20 inside the shell 10, and then the gas is sucked into the compressing space. Therefore, the specific volume of the refrigerant gas is increased, and the performance of the compressor is lowered.

Also, when the suction valve 33 is opened/closed, the suction valve 33 is impacted to the front end surface of the piston 31, whereby the impact noise generated thereof is transferred to inside of the shell 10 entirely, and the noise of the entire compressor is increased.

In addition, when the suction valve 33 is opened/closed, the counter-flowing refrigerant gas is impacted with the sucked refrigerant gas instantaneously, whereby a pressure pulsation is generated. And the pressure pulsation is transferred to the suction pipe (SP) through the inner flowing passage 31*a* of the piston 31, and thereby the suction of the refrigerant gas is disturbed and the efficiency of the compressor is lowered.

DISCLOSURE OF THE INVENTION

Therefore, to solve the problems of the conventional art, it is an object of the present invention to provide a suction gas guiding system for a reciprocating compressor which increase efficiency of the compressor by introducing sucked gas inside a shell to a compressing space, and thereby increasing a density of the refrigerant gas per unit volume.

Also it is an another object of the present invention to provide a suction gas guiding system for a reciprocating compressor which is able to increase the efficiency of the compressor by preventing the sucked gas from being preheated before introduced into the compressing space and thereby preventing the increase of a specific volume of the gas.

In addition, it is still another object of the present invention to provide a suction gas guiding system for a reciprocating compressor which is able to reduce the noise of the compressor by attenuating an impact noise generated from impact of the suction valve to a front end surface of the piston when the refrigerant gas is sucked.

Also it is still another object of the present invention to provide a suction gas guiding system for a reciprocating compressor which is able to suck the refrigerant gas smoothly by attenuating a pressure pulsation generated from opening/closing of the suction valve.

To achieve these objects of the present invention, there is provided a reciprocating compressor including a shell in which a suction pipe and a discharge pipe are communicated with each other; a reciprocating motor including a stator comprising an inner stator and an outer stator which are fixed inside the shell having a certain air gap, and an armature disposed in the air gap between the two stators and undergoing a reciprocating movement; a compressor unit including a piston coupled to the armature of the reciprocating motor, undergoing the reciprocating movement together with the armature, and having an inner flowing passage is formed penetrating inside the piston, and a cylinder supported inside the reciprocating motor so as to form a compressing space by inserting the piston inside the cylinder; a frame unit supporting the reciprocating motor and the compressing unit; and a spring unit elastically supporting the armature of the reciprocating motor in motion direction, wherein a suction gas guiding system including a gas guide conduit having both ends installed to oppose from each other in the suction pipe and in the inner flowing passage, and introducing the gas sucked into the shell through the suction pipe to the inner flowing passage of the piston is provided.

MODES FOR CARRYING OUT THE PREFERRED EMBODIMENTS

Hereinafter, the suction gas guiding system of the reciprocating compressor according to the present invention will be described with reference to the accompanying drawings.

Figure 1:
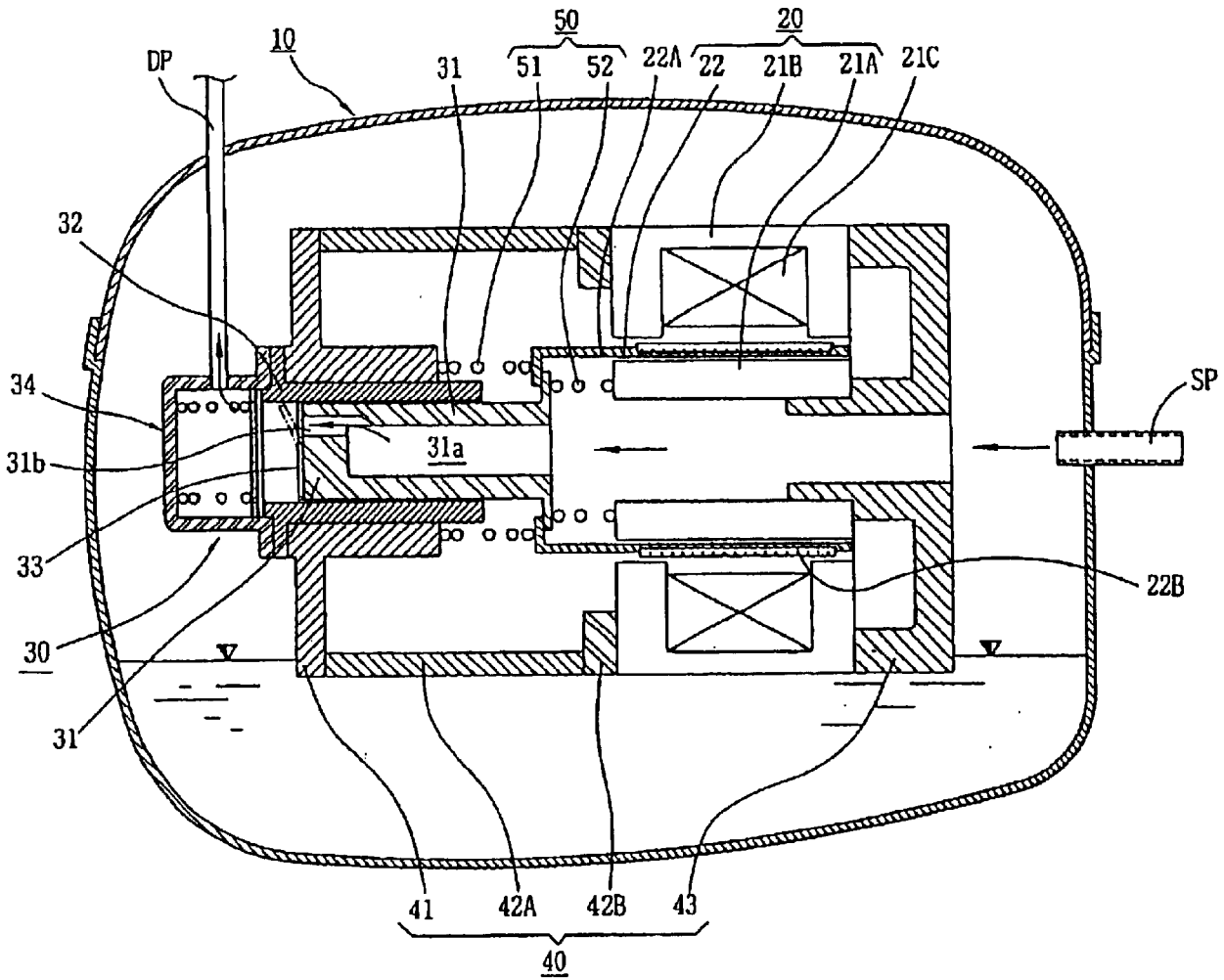
FIG. 1 is a transverse cross-sectional view showing a conventional reciprocating compressor.
Figure 2:
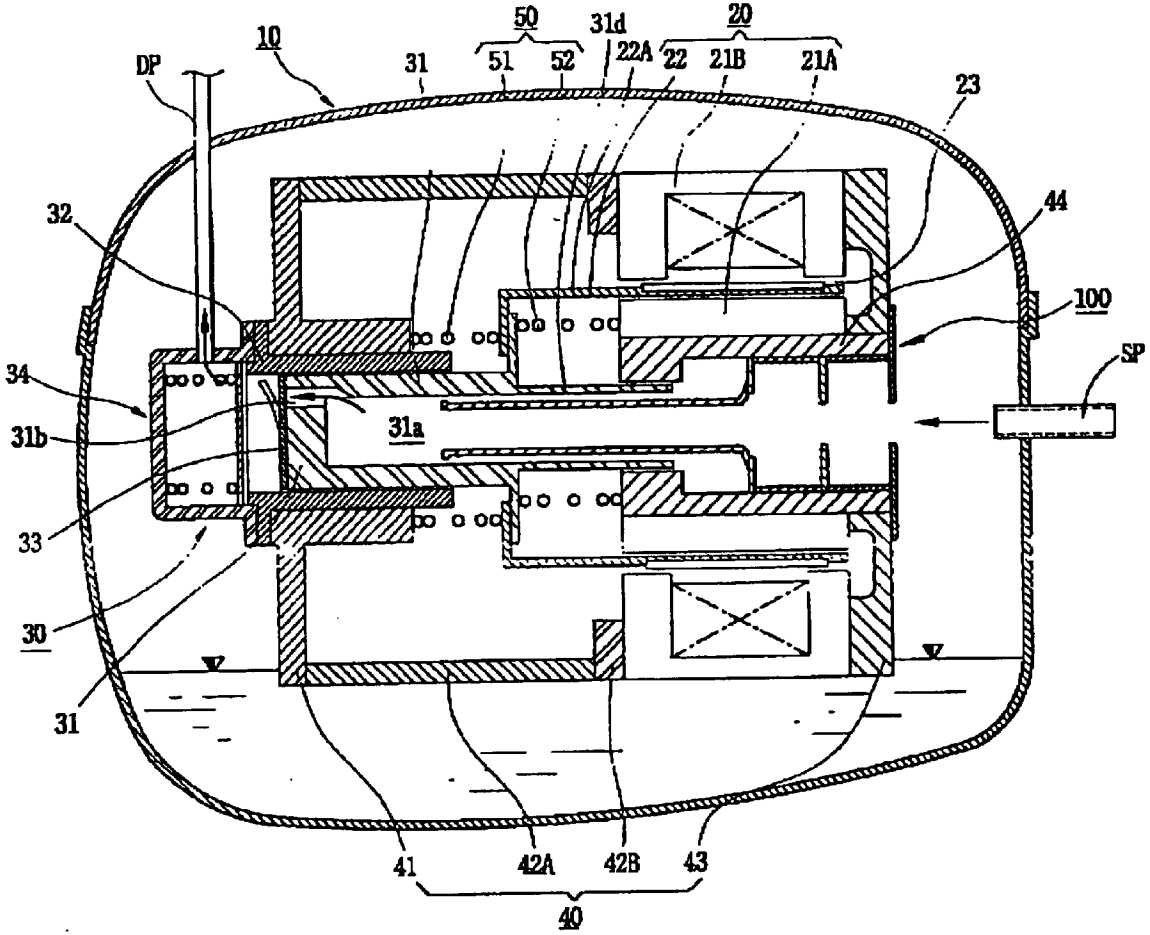
FIG. 2 is a transverse cross-sectional view showing a reciprocating compressor according to the present invention.
Figure 3:
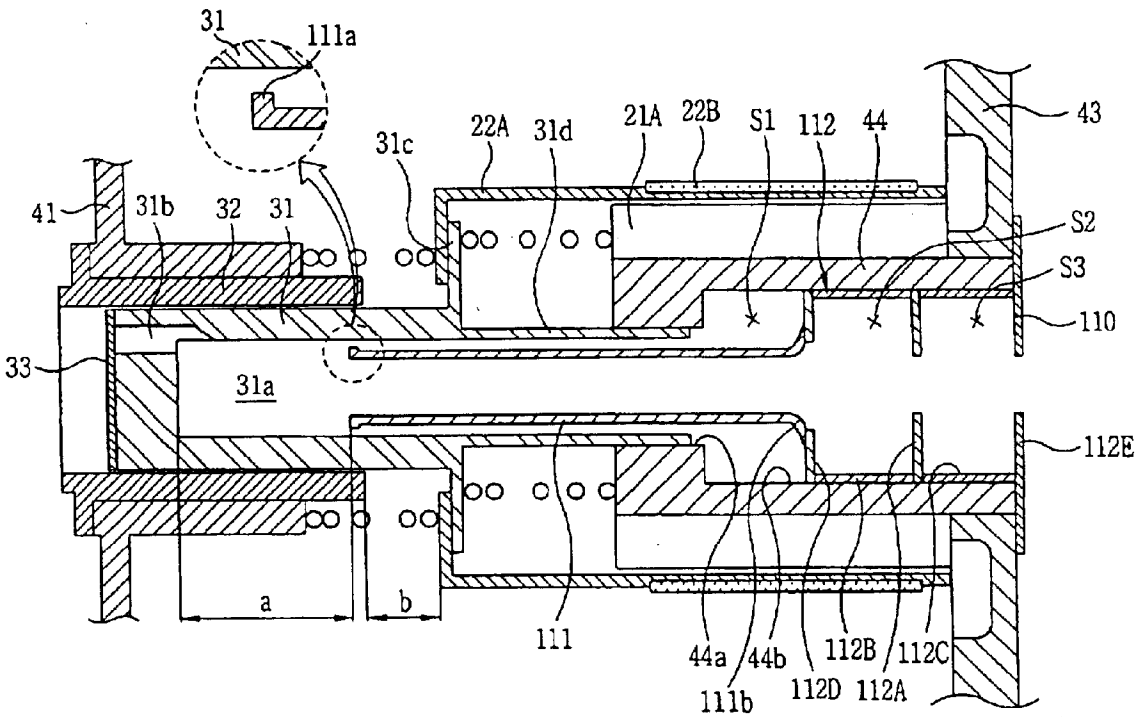
FIG. 3 is a transverse cross-sectional view showing the reciprocating compressor centering around a suction gas guiding system according to the present invention.

As shown in FIG. 2 and FIG. 3, the reciprocating compressor including the suction gas guiding system according to the present invention comprises a shell 10 in which a suction pipe (SP) and a discharge pipe (DP) are communicated; a reciprocating motor 20 fixed inside the shell; a compressing unit 30 installed inside the reciprocating motor, sucking, compressing and discharging a gas; a frame unit 40 supporting the reciprocating motor 20 and the compressor unit 30; a spring unit 50 elastically supporting an armature 22 of the reciprocating motor 20 in a motion direction and guiding a resonance; and gas guide unit 100 installed between the compressing unit 30 and the frame unit 40, and guiding the sucked gas.

The reciprocating motor 20 includes a stator 21 comprising an inner stator 21A and an outer stator 21B, and an armature 22 disposed in an air gap 23 generated between the inner stator 21A and the outer stator 21B, and undergoing a reciprocating movement.

The inner stator 21A is a cylindrical shape and is press fitted and supported on a motor supporting member 44 coupled to the rear frame 43 which will be described later.

The outer circumference of the motor supporting member 44 is formed as a cylinder, but the inner circumference of the motor supporting member 44 has a stepped part so that a small conduit unit 44*a* and a large conduit unit 44*b* are formed inside. The inner surface of the small conduit unit 44*a* is formed to be adjacent to the outer surface of the extended part 31*d* of the piston 31 which will be described later, and the inner surface of the large conduit unit 44*b* is formed to form a first resonant space (S1) by having a certain distance from the outer surface of a gas guide conduit 110 which will be described later.

The compressor unit 30 includes a piston 31 coupled to the magnet supporting member 22A of the reciprocating motor 20, and undergoing reciprocating movement together; a cylinder 32 fixed to a front frame 41, which will be described later, so that the piston inserted into the cylinder slidably, and forming a compressing space with the piston; a suction valve 33 installed on the front end of the piston 31 and restricting suction of the gas by opening/closing a gas passing hole 31*b* of the piston 31, which will be described later; and a discharge valve assembly 34 installed on front end surface of the cylinder 32, covering the compressing space, and restricting discharge of the compressed gas.

An inner flowing passage 31*a* communicated with the suction pipe (SP) is formed to have a certain depth inside the piston 31, and a gas passing hole 31*b* communicating with the inner flowing passage 31*a* and penetrated to the front end surface of the piston is formed inside the piston 31. On rear end of the piston, a flange unit 31*c* coupled to the magnet supporting member 22A is formed, and a extended conduit unit 31*d* extending toward the reciprocating motor 20 from the rear end is formed to communicate to the inner flowing passage 31*a*.

The extended conduit unit 31*d* is formed to be partially overlapped with the small conduit unit 44*a* of the motor supporting member 44 always, when the piston 31 undergoes reciprocating movement.

The frame unit 40 includes a front frame 41 in which the cylinder 32 is inserted and coupled; a first middle frame 42A coupled to the front frame. 41 and protecting the compressor unit 30; a second middle frame 42B coupled to the first middle frame 42A and contacting to the front side surface of the outer stator 21B; and a rear frame 43 coupled to the second middle frame 42B and contacting to rear side surfaces of the inner stator 21A and of the outer stator 21B, whereby supporting those two stators together.

The spring unit 50 includes a front spring 51 having both ends supported by front surface of the coupled part of the magnet supporting member 22*a* and the piston 31 and by inner surface of the front frame 41 respectively, and a rear spring 52 having both ends supported by rear surface of the coupled part of the magnet supporting member 22A and the piston 31 and by the front surface of the inner stator 21A respectively.

Figure 4:
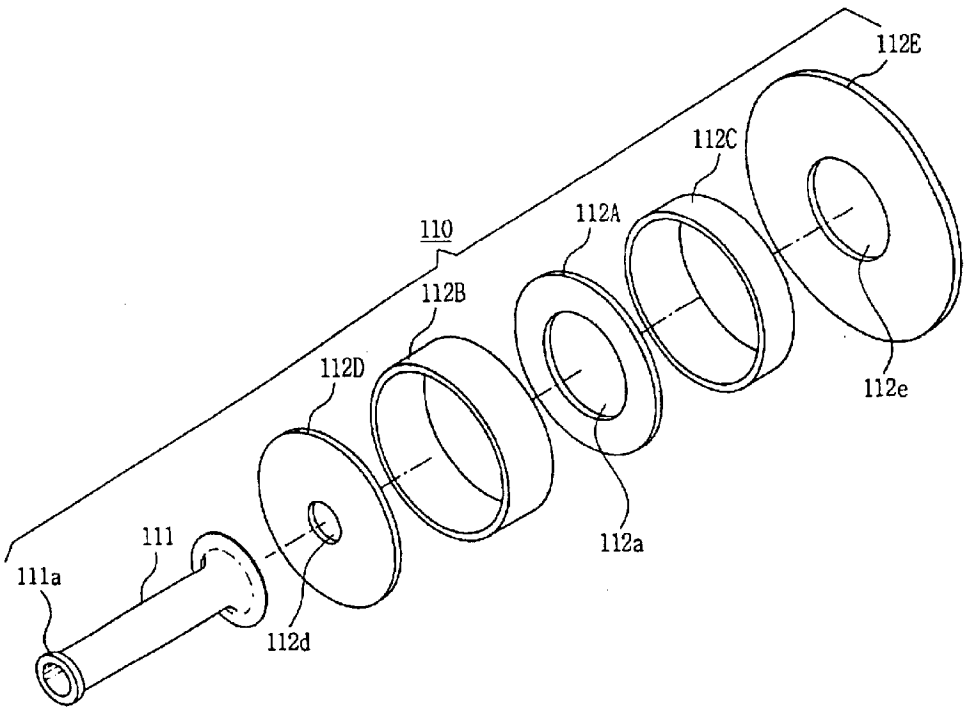
FIG. 4 is an exploded perspective view showing the suction gas guiding system of the reciprocating compressor according to the present invention.

As shown in FIG. 2 or FIG. 4, the gas guide unit 100 includes at least one gas guide conduit 110 (a gas guide conduit is shown in Figures) coupled to the rear surface of the rear frame 43 and inserted inside the motor supporting member 44 so as to be overlapped with the extended part 31*d* of the piston 31.

The gas guide conduit 110 includes a small conduit unit 111 having inner diameter shorter than that of the extended part 31*d* so that the front part of the conduit 110 is inserted into the extended part 31*d* with a certain gap, and a large conduit unit 112 formed on entrance side of the small conduit unit 111 and having a plurality of resonant spaces (S2 and S3).

The small conduit unit 111 is able to be inserted into the inner flowing passage 31*a* of the piston, and in that case, the distance (a) from the front end of the small conduit unit 111 to the inner end of the inner flowing passage 31*a* of the piston is longer than the distance (b) between the front surface of the flange unit 31*c* of the piston 31 and the rear end of the cylinder 32 corresponding to that.

Also, a bent-up part 111*a* enlarged outward is formed protrusive from the end of the small conduit part 111 so as to form the resonant space (S1) with the extended part 31*d* of the frame 31.

On the other hand, the baffle unit 112A for dividing the inside of the large conduit unit 112 into a plurality of resonant spaces (S2 and S3) is formed at least one (a baffle unit is shown in Figure) on the large conduit unit 112, and the baffle unit 112A is installed in a vertical direction against the flowing direction of the gas.

The large conduit unit 112 includes a baffle unit 112A, a first conduit unit 112B and a second conduit unit 112C forming the second and third resonant spaces (S2 and S3) by coupling to both sides of the baffle unit 112A, and a first side plate unit 112D and a second side plate unit 112E coupled to the other sides of the first and second conduit units 112B and 112C, respectively.

The outer diameters of the first and second conduit units 112B and 112C are formed same as those of the baffle unit 112A and respective side plate units 112D and 112E, and bores 112*a*, 112*d*, and 112*e* located on the same axial lines of the suction pipe (SP), the small conduit units 111, and the inner flowing passage 31*a* are formed on the central part of the baffle unit 112A and the respective side plate units 112D and 112E.

The first side plate unit 112D is located on front side of the large conduit unit 112, and the small conduit unit 111 is coupled on the bore 112d. In addition, a flange unit (not defined) coupling to the rear frame 43 is formed on the second side plate unit 112E.

Also, it is desirable that the entrance end 111*b* of the small conduit unit 111 is formed roundly. And the first conduit unit 112B and the first side plate unit 112D might be formed as a single body, and the other components are coupled and welded by using the ultrasonic welding or brazing method.

Same components as those of the conventional art are designated by the same reference numerals.

Reference 22B designates a magnet.

The suction gas guiding system for a reciprocating compressor as described above has the effects as follows.

That is, when an electric source is applied to the reciprocating motor 20, accordingly a flux is formed between the inner stator 21A and the outer stator 21B, whereby the armature 22 with the piston 31 moves in accordance with the direction of the flux and undergoes linear reciprocating movement by the spring unit 50. Then, the piston 31 coupled to the armature 22 undergoes the linear reciprocating movement inside the cylinder 32 so that a pressure variance is repeatedly generated inside the cylinder 32. Accordingly, due to the pressure variance inside the cylinder 32, the refrigerant gas is sucked into the compressing space of the cylinder 32 through the inner flowing passage 31*a* in the piston 31, then compressed and discharged. And this process is repeated.

The process will be described in more detail as follows.

Figure 5:
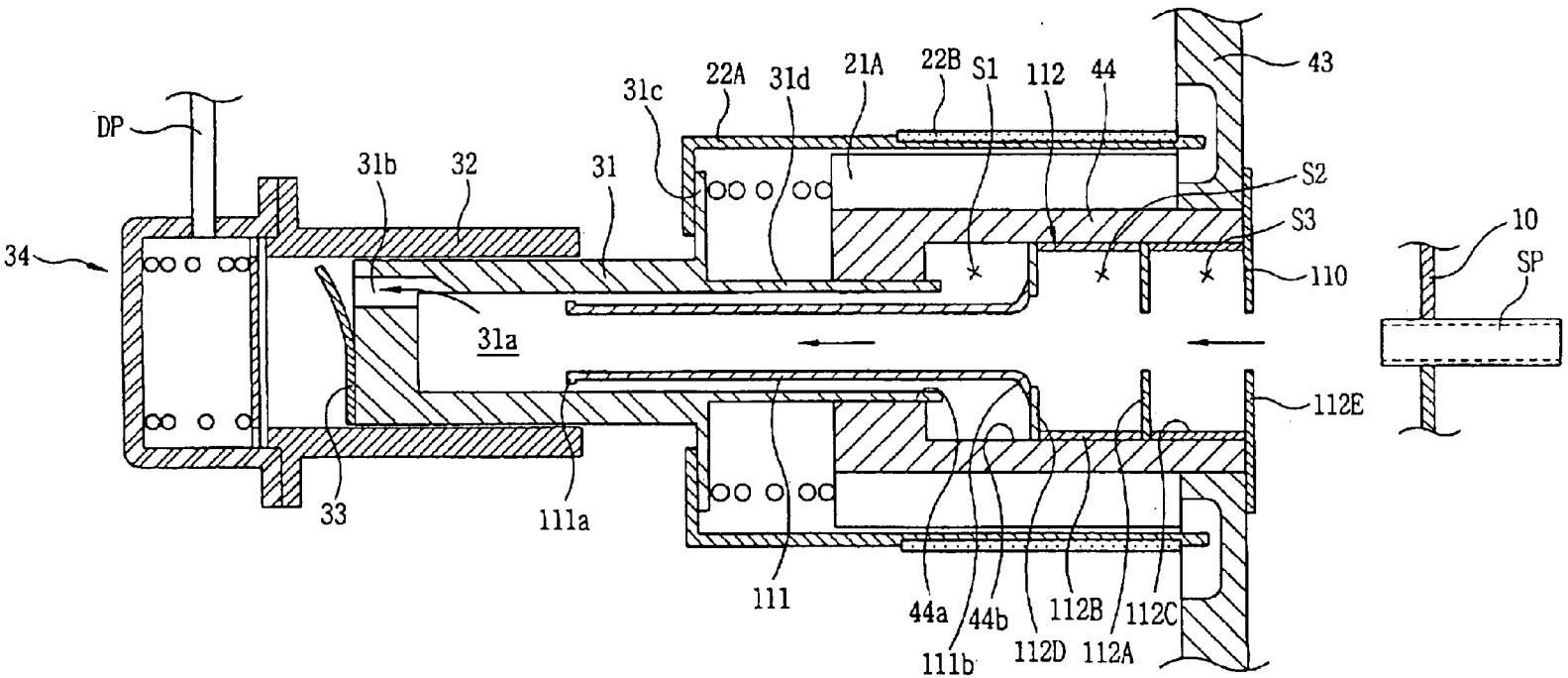
FIG. 5 is a transverse cross-sectional view showing an operating state of the reciprocating compressor according to the present invention.

First, as shown in FIG. 5, the refrigerant gas (indicated as the real line arrow in drawing) is sucked and charged inside the shell 10 through the suction pipe (SP) during the suction stroke of the piston 31, and after that, the refrigerant gas charged in the shell 10 is sucked into the compressing space of the cylinder 32 as opening the suction valve 33 through the large conduit unit 112 and the small conduit unit 111 of the gas guide conduit 110, and the gas passing hole 31*b* and the inner flowing passage 31*a* of the piston 31 during the continued suction stroke of the piston 31.

At that time, before the refrigerant gas sucked into the shell 10 is dispersed entire shell 10, the gas is guided to the inner flowing passage 31*a* of the piston through the gas guide conduits 110 and the extended part 31*d*, and the refrigerant gas guided into the inner flowing passage 31*a* is directly sucked into the compressing space as opening the suction valve 33 through the gas passing 31*b*, whereby the density of the gas per unit volume is increased, and therefore the efficiency of the compressor is able to be increased.

Also, as the refrigerant gas sucked into the shell 10 through the suction pipe (SP) is guided to the compressing space of the cylinder 43 through the gas guide conduit 110, a direct contact of the gas to the motor can be prevented to a certain extent. And thereby increase of the specific volume of the refrigerant gas is able to be restrained, and accordingly, the amount of sucked gas is increased, whereby the efficiency of the compressor can be increased.

Also, the gas guide conduit 110 and the extended part 31*d* of the piston 31 are disposed to be overlapped with each other during the reciprocating movement, accordingly, the leakage of the refrigerant gas is prevented when the refrigerant gas is sucked. Therefore, the suction rate of the refrigerant gas is increased, and the efficiency of the compressor is able to be increased.

Also, the suction pipe (SP), the gas guide conduit 110, and the extended part 31*d* are disposed on same axial line as that of the inner flowing passage 31*a* of the piston 31, and the entrance end 111*b* of the small conduit unit 111 in the gas guide conduit 110 is formed roundly, whereby the suction of the refrigerant gas is made smoothly, the suction rate of the refrigerant gas is increased, and therefore the efficiency of the compressor can be increased.

Figure 6:
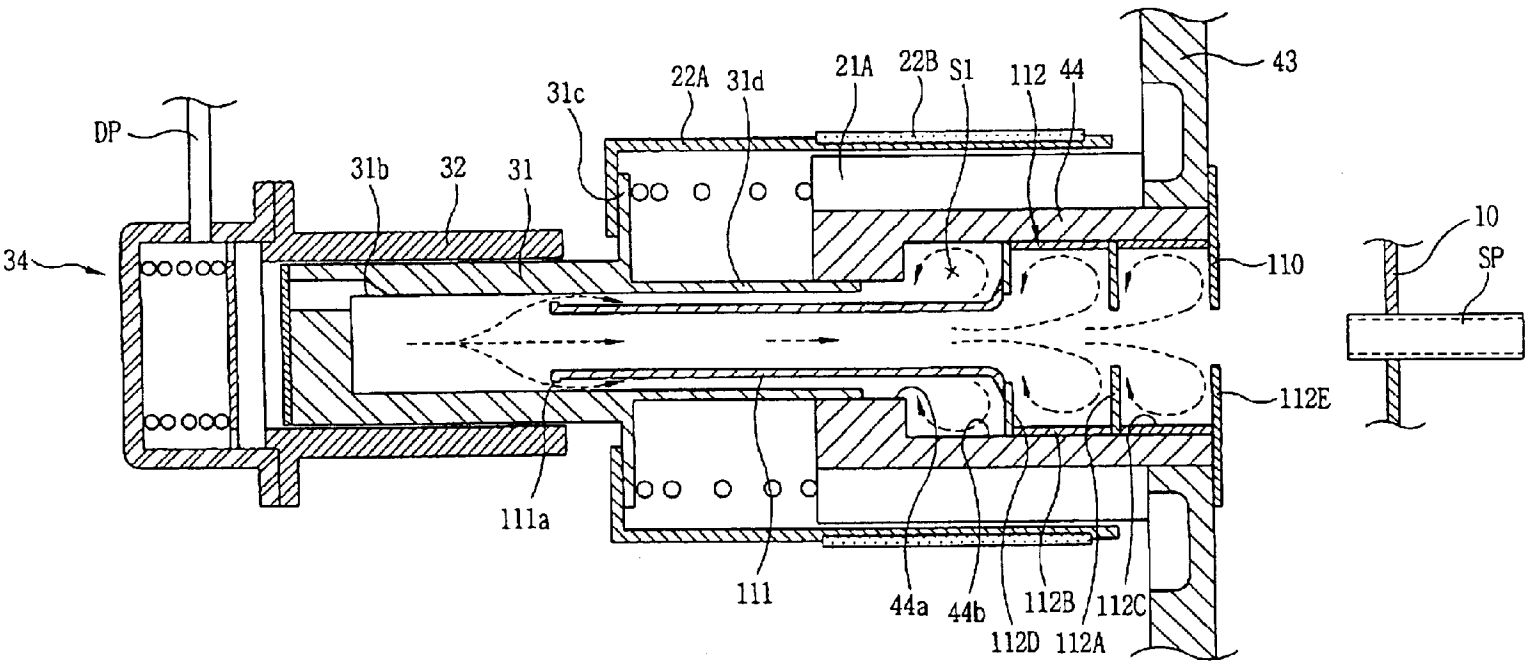
FIG. 6 is a transverse cross-sectional view showing an operating state of the reciprocating compressor according to the present invention.

After that, as shown in FIG. 6, the refrigerant gas in the compressing space of the cylinder 32 is compressed during the compressing stroke of the piston 31, and then the gas is discharged as opening the discharge valve 34.

At that time, the suction valve 33 opened during the suction of the refrigerant gas is closed, and then the suction valve 33 is impacted to the front surface of the piston 31, whereby an impact noise (indicated as dotted line arrows in drawing) between the valve 33 and the piston 31 is generated. And the noise is flows to the opposite of the suction direction of the gas.

However, the noise of low frequency is attenuated in the first resonant space (S1) formed between the large conduit unit 44*b* of the motor supporting member 44 and the outer circumferential surface of the small conduit unit 111 of the gas guide conduit 110, and the noise of high frequency is attenuated through the second resonant space (S2) and the third resonant space (S3) formed on the large conduit unit 112 in the gas guide conduit 110, whereby the reliability of the compressor is increased.

Also, as the suction valve 33 is opened/closed, some of the refrigerant gas being sucked is counter flown, and accordingly the counter-flowing refrigerant gas causes a pressure pulsation by impact with the refrigerant gas being sucked through the inner flowing passage 31*a* of the piston 31. Then, the pressure pulsation disturbs the suction of the refrigerant gas by flowing to the opposite of the suction direction.

However, the pressure pulsation is somewhat attenuated with the impact noise while flowing through the respective resonant space (S1, S2, and S3), whereby the amount of the refrigerant gas newly sucked is able to be increased, and the efficiency of the compressor can be increased.

Also, when the gas guide conduit 110 is assembled, the large conduit unit 130 is formed such that a plurality of members are molded, and after that the components are coupled by using the ultrasonic welding or brazing method, whereby the gas guide conduit 110 is assembled in simple way, and the productivity can be increased.

Hereinafter, an another embodiment of the suction gas guiding system for a reciprocating compressor according to the present invention will be described.

That is, in the above described embodiment, the gas guide unit includes one gas guide conduit, but there are provided a plurality of gas guide conduits in the present embodiment.

Figure 7:
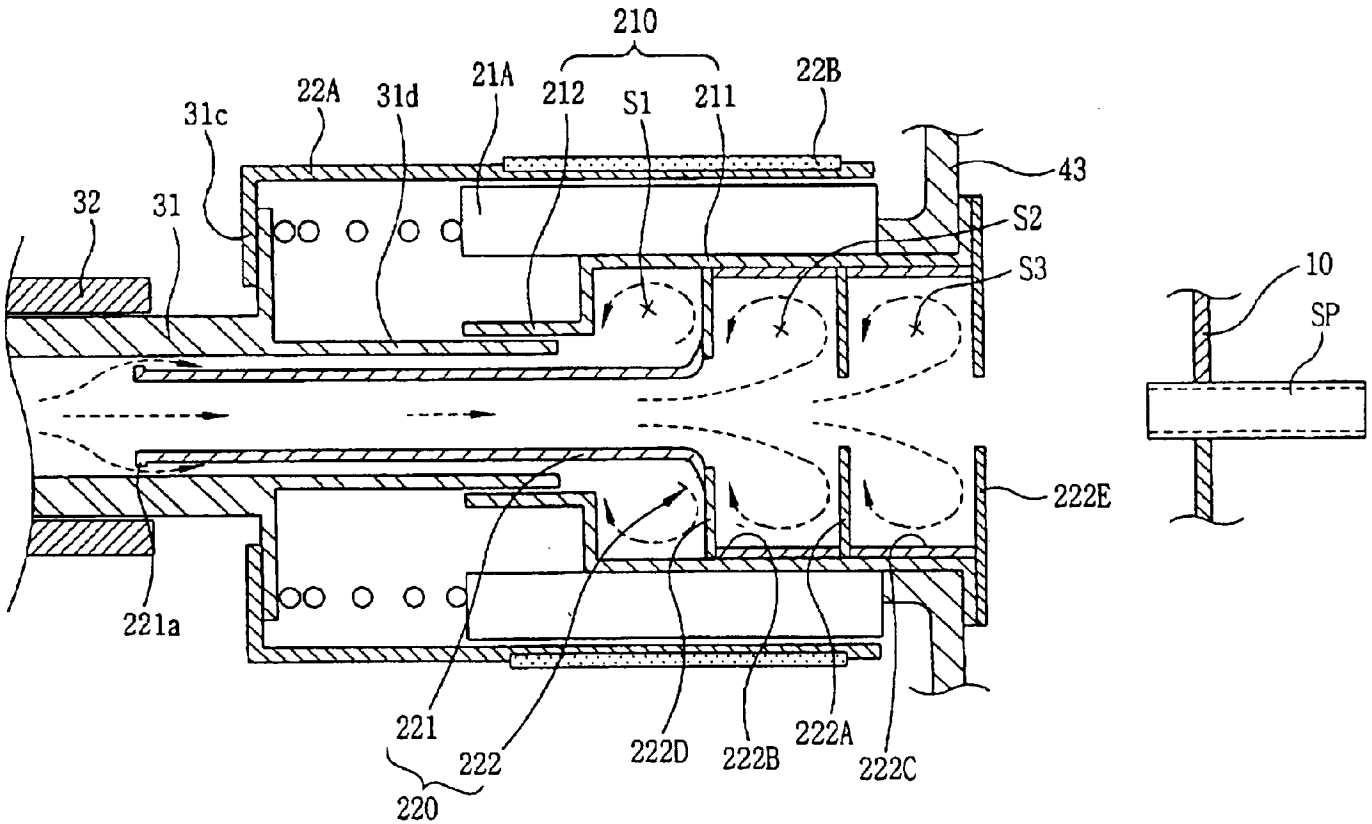
FIG. 7 is a transverse cross-sectional view showing another embodiment of the suction gas guide system of the reciprocating compressor according to the present invention.

As shown in FIG. 7, in the present embodiment, a first guide conduit 210 inserted into the inner bore (not defined) in the inner stator 21A and overlapped with the extended part 31*d* of the piston 31 is coupled to the rear frame 43, and a second guide conduit 220 inserted into the first guide conduit 210 is coupled to the rear frame 43 with the first guide conduit 210.

The first guide conduit 210 includes a large conduit unit 211 abuts to the inner surface of the inner stator 43, and a small conduit unit 212 stepped from the large conduit unit 211 in an axial direction, in which the extended part 31*d* of the piston 31 is inserted so as to be overlapped always.

It is desirable that the outer diameter of the small conduit unit 212 is shorter than inner diameter of the extended part 31*d* of the piston 31, however, on occasion, the inner diameter of the small conduit unit 212 is larger than the outer diameter of the extended part 31*d*, whereby the extended part 31*d* is able to be inserted inside the small conduit unit 212.

On the other hand, the second guide conduit 220 includes a small conduit unit 221 inserted into the extended part 31*d* or into the inner flowing passage 31*a* of the piston 31, and a large conduit unit 222 formed enlarging from the entrance of the small conduit unit 221 and communicated with the small conduit unit 221.

The outer diameter of the small conduit unit 221 is formed to be shorter than the inner diameter of the extended part 31*d*, whereby the small conduit unit 221 is able to be inserted deeply into the extended part 31*d*, and on the front end of the small conduit unit 221, a flange unit 221*a* outwardly extended is formed so as to face the inner surface of the inner flowing passage 31*a* of the piston 31 or the inner surface of the extended part 31*d* of the piston 31.

The outer circumferential surface of the large conduit unit 222 is formed so as to abut inner surface of the large conduit unit 211 of the first guide conduit 210, and the length of the transverse direction of the large conduit unit is shorter than that of the large conduit unit 211 of the first guide conduit 210 so that the first resonant space (S1) is disposed between the first guide conduit 210 and the second guide conduit 220.

Also, the large conduit unit 222 includes a baffle unit 222A dividing the inside of the large conduit unit 222 into a plurality of resonant spaces (S2 and S3), a first conduit unit 222B and a second conduit unit 222C forming the second and third resonant spaces (S2 and S3) by coupling to both sides of the baffle unit 222A, and a first side plate unit 222D connected to the small conduit unit 221 and a second side plate unit 222E coupled to the rear frame 43, which are coupled to the other sides of the first and second conduit units 222B and 222C.

Therefore, the noise of low-frequency generated when the suction valve is opened/closed is attenuated in the first resonant space (S1), and the noise of high-frequency is attenuated in the second and third resonant spaces (S2 and S3) of the large conduit unit through the second guide conduit 220, whereby the noise of the compressor is able to be reduced efficiently.

The effects described in the above embodiment are similar with those of the present embodiment, and accordingly, the description for that will be omitted.

Hereinafter, an another embodiment of the present invention will be described.

Figure 8:
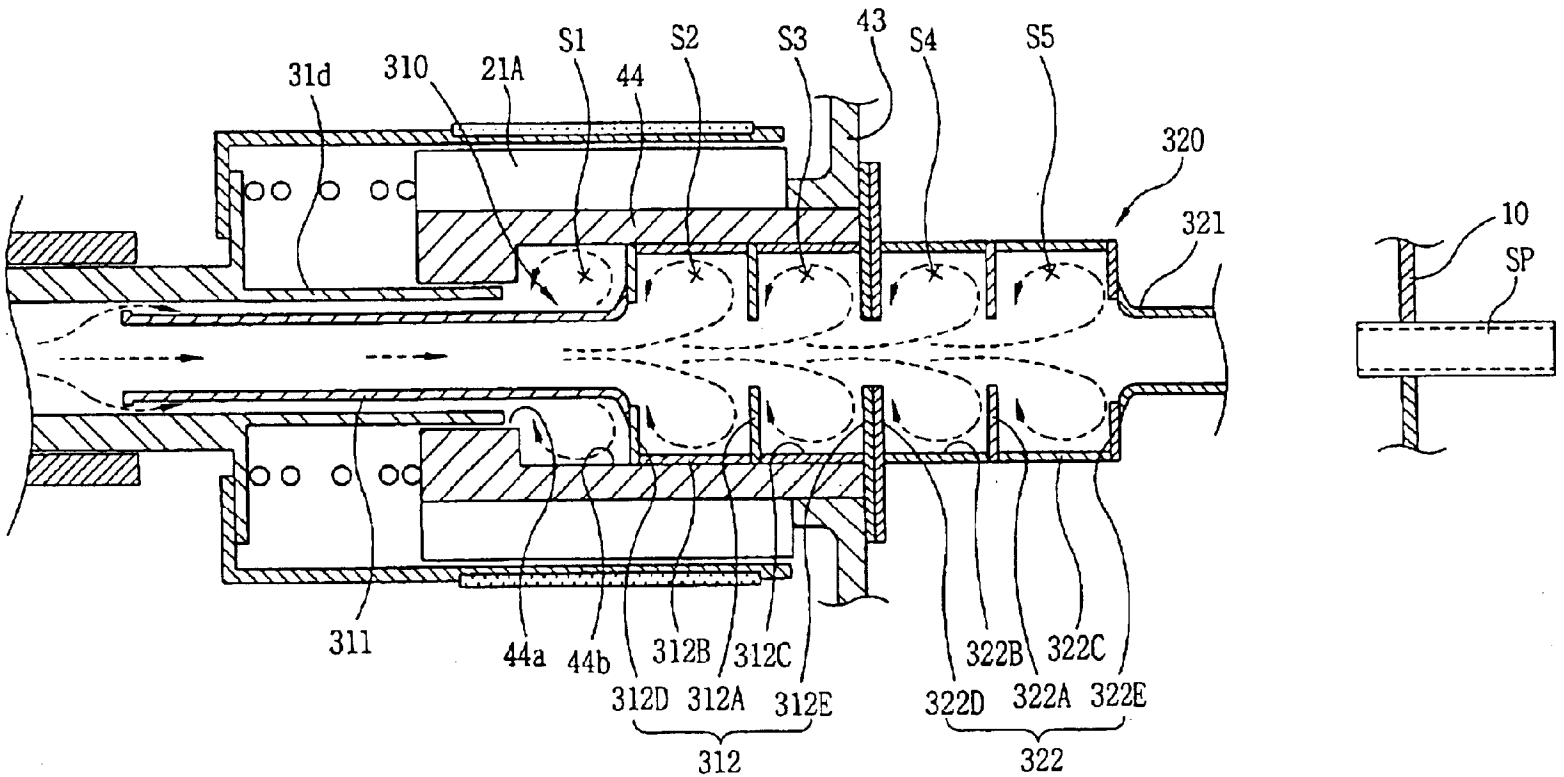
FIG. 8 is a transverse cross-sectional view showing an another embodiment of the suction gas guiding system of the reciprocating compressor according to the present invention.

That is, in the embodiments described above, one large conduit unit is provided, but in the present embodiment, there are provided a plurality of large conduit units. As shown in FIG. 8, the inner stator 21A is fixed on the outer circumferential surface of the motor supporting member 44, and a first guide conduit 310 having a first large conduit unit 312 is inserted into the large conduit unit 44*b* of the motor supporting member 44 and is fixed on the rear frame. In addition, a second guide conduit 320 having a second large conduit unit 322 is fixed on the outside of the motor supporting member 44 with the first guide conduit 310.

The motor supporting member 44 and the first guide conduit 310 are formed in same method as that of the embodiment shown in FIGS. 2 and 4, however, the second guide conduit 320 is formed extending toward the suction pipe (SP) of the shell 10.

The first large conduit unit 312 of the first guide conduit 310 includes a baffle unit 312A, a first and second conduit units 312B and 312D, and a first and second side plate units 312D and 312E, so that the second and third resonant spaces are formed inside the first large conduit unit 312. Reference 311 designates the small conduit unit.

The second guide conduit 320 includes the second large conduit unit 322 on the part contacted to the rear frame 43.

The second large conduit unit 322 includes a baffle unit 322A, a first conduit unit 322B and a second conduit unit 322C forming a fourth resonant space (S4) and fifth resonant space (S5) on both sides of the baffle unit 322A, and a first side plate unit 322D and a second side plate unit 322E.

In that case, the noise of low-frequency among the noise generated when the suction valve is opened/closed is attenuated in the first resonant space (S1), and the noise of high-frequency is attenuated going through the second, third, fourth, and fifth resonant spaces (S2, S3, S4, and S5), whereby the noise reducing effect can be increased.

On the other hand, the gas guide unit according to the present invention might be formed such that the embodiments shown in FIG. 7 and FIG. 8 are mixed, although it is not shown in Figure. In this case, the second guide conduit shown in FIG. 7 may be formed as a middle guide conduit located between the first and second guide conduits shown in FIG. 8. And various embodiments within the technical scope of the present invention may be further provided.

INDUSTRIAL APPLICABILITY

As described above, in the suction gas guiding system for a reciprocating compressor according to the present invention, the gas guide conduit having both ends installed on the suction pipe of the shell and on the inner flowing passage of the piston respectively so as to face each other, and installed on the same axial line with the resonant space so that the sucked gas inside the shell through the suction pipe is guided to the inner flowing passage of the piston is provided. Accordingly, the refrigerant gas is sucked into the inner flowing passage of the piston through the gas guide conduit smoothly, and then the suction rate of the refrigerant gas is increased. In addition, the noise and vibration generated when the refrigerant gas is sucked is attenuated in the resonant spaces, the flow resistance against the noise and the sucked gas is reduced, whereby the reliability and the efficiency of the compressor is able to be increased.

Also, the pre-heating of the refrigerant gas sucked into the shell by the motor is prevented, and therefore the specific volume of the refrigerant gas is not increased, whereby the efficiency of the compressor is increased.

Also, the gas guide conduit is assembled after a plurality of components are molded, and therefore the assembling process of the gas guide conduit is easy, whereby the productivity of the compressor can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. In a reciprocating compressor comprising:

a shell in which a suction pipe and a discharge pipe are communicated;

a reciprocating motor including a stator having an inner stator and an outer stator fixed inside the shell with an air gap between them, and an armature disposed in the air gap between the two stators and undergoes reciprocating movement;

a compressor unit including a piston coupled to the armature of the reciprocating motor and undergoing reciprocating movement with the armature, in which an inner flowing passage is installed penetrating inside of the piston, and a cylinder supported on outside of the reciprocating motor so that the piston is inserted into the cylinder slidably;

a frame unit connecting and supporting the reciprocating motor and the compressor unit; and a spring unit elastically supporting the armature of the reciprocating motor in the motional direction;

wherein a suction gas guide system including a gas guide conduit located inside the inner stator and having both ends aligned with the suction pipe and on the inner flowing passage of the piston to face each other, so as to guide the sucked gas inside the shell to the inner flowing passage of the piston is provided;

wherein the gas guide conduit which is smaller than the diameter of the inner flowing passage of the piston, extends to the inner flowing passage of the piston so that at least part of the gas guide conduit overlaps the inner flowing passage of the piston.

2. The system according to claim 1, wherein the end part of the gas guide conduit has a flange unit bent toward inner surface of the inner flowing passage of the piston.

3. The system according to claim 1, wherein the piston further includes an extended part extended toward the inner stator from a coupled part that couples the piston with the armature.

4. The system according to claim 1, wherein distance from the front end of the gas guide conduit to the inner end part of the piston is longer than the distance from the one side of a coupled part that couples the armature and the piston to the rear side of the cylinder corresponding to that.

5. The system according to claim 1, wherein a flange unit is formed on the gas guide conduit so that the gas guide conduit is coupled to the frame unit.

6. The system according to claim 1, wherein the gas guide conduit includes a large conduit unit having an enlarged inner diameter.

7. In a reciprocating compressor comprising:

a shell in which a suction pipe and a discharge pipe are communicated;

a reciprocating motor including a stator having an inner stator and an outer stator fixed inside the shell with an air gap between them, and an armature disposed in the air gap between the two stators and undergoes reciprocating movement;

a compressor unit including a piston coupled to the armature of the reciprocating motor and undergoing reciprocating movement with the armature, in which an inner flowing passage is installed penetrating inside of the piston, and a cylinder supported on outside of the reciprocating motor so that the piston is inserted into the cylinder slidably;

a frame unit connecting and supporting the reciprocating motor and the compressor unit; and a spring unit elastically supporting the armature of the reciprocating motor in the motional direction;

wherein a suction gas guide system including a gas guide conduit located inside the inner stator and having both ends aligned with the suction pipe and on the inner flowing passage of the piston to face each other, so as to guide the sucked gas inside the shell to the inner flowing passage of the piston is provided;

wherein the piston further includes an extended part extended toward the inner stator from a coupled part that couples the piston with the armature and wherein the extended part is extending to the flowing passage formed inside the inner stator, and is overlapped with the inner stator at one point, at least.

8. The system according to claim 7, wherein a motor supporting member supporting the inner stator is inserted on the central part of the reciprocating motor, and the inner circumference of the motor supporting member includes a stepped part so that a small conduit unit and a large conduit are formed inside.

9. In a reciprocating compressor comprising:

a shell in which a suction pipe and a discharge pipe are communicated;

a reciprocating motor including a stator having an inner stator and an outer stator fixed inside the shell with an air gap between them, and an armature disposed in the air gap between the two stators and undergoes reciprocating movement;

a compressor unit including a piston coupled to the armature of the reciprocating motor and undergoing reciprocating movement with the armature, in which an inner flowing passage is installed penetrating inside of the piston, and a cylinder supported on outside of the reciprocating motor so that the piston is inserted into the cylinder slidably;

a frame unit connecting and supporting the reciprocating motor and the compressor unit; and a sprint unit elastically supporting the armature of the reciprocating motor in the motional direction;

wherein a suction gas guide system including a gas guide conduit located inside the inner stator and having both ends aligned with the suction pipe and on the inner flowing passage of the piston to face each other, so as to guide the sucked gas inside the shell to the inner flowing passage of the piston is provided, wherein there are provided a plurality of gas guide conduits.

10. The system according to claim 9, wherein at least one gas guide conduit among those guide conduits includes the large conduit unit having enlarged diameter.

11. The system according to claims 8 or 10, wherein the large conduit unit is fixed in the inside of the motor supporting member having a gap with the small conduit unit of the motor supporting member.

12. The system according to claim 9, wherein the gas guide conduits are disposed so as to be overlapped at least on one point.

13. The system according to claim 9, wherein at least one gas guide conduit among those conduits includes a flange unit so as to couple to the frame unit.

14. The system according to claim 9, wherein the gas guide conduits include a first guide conduit opposed with the suction pipe, and a second guide conduit opposed with the piston.

15. The system according to claim 14, wherein at least one middle guide conduit is disposed between the first guide conduit and the second guide conduit.

16. The system according to claim 14, wherein one of those first, second and middle guide conduits includes a large conduit unit having an enlarged diameter.

17. The system according to claim 14 or claim 15, wherein one of those first, second, and middle guide conduits includes a flange unit coupled to the frame unit.

18. The system according to claim 14 or claim 15, wherein one of those first, second, and middle guide conduits is disposed to be overlapped with the other.

19. The system according to claim 15, wherein one of those first and second guide conduits includes a flange unit and coupled outside of the frame unit, and the other is coupled to the inner surface of the said frame unit.

20. The system according to claim 15, wherein one of those first, second and middle guide conduits includes the flange unit and is coupled to outside of the frame unit, and the others are coupled to inside of the frame unit.

21. The system according to claims 6, 10, or 16, wherein the large conduit unit includes a cylindrical conduit, and a first side plate unit and a second side plate unit coupled to the both ends of the conduit and having bores with smaller diameter than the inner diameter of the conduit, and one of the first and second side plate units is molded with the conduit as a single body and the other is coupled to the conduit using ultrasonic welding or brazing method.

22. The system according to claims 6, 10, or 16, wherein the large conduit unit includes a cylindrical conduit unit, and a first side plate unit and a second, side plate unit coupled to both ends of the outer of the outer circumference of the conduit unit and having bores with smaller diameter than the inner diameter of the conduit unit, and one of the first and second side plate units is coupled to the conduit unit by using ultrasonic welding or brazing method.

23. The system according to claims 6, 10, or 16, wherein the large conduit unit is fixed on the frame opposed to the suction pipe of the shell among the frame unit.

24. The system according to claims 6, 10, or 16, wherein the large conduit unit includes at least a baffle unit diving inside the large conduit unit into a plurality of resonant spaces communicating with each other.

25. The system according to claims 6, 10, or 16, wherein the large conduit unit includes at least one baffle unit dividing inside the large conduit unit into a plurality of resonant spaces communicating each other, and the baffle unit includes a bore on the same axial line with the suction pipe.

26. The system according to claims 1, 2, 3, 7, 4, 5, 8, 6, 9, 10, 12, 13, 14, 15, 16, 19, or 20, wherein the gas guide conduits are disposed on the one axial line.

* * * * *